US008578857B2

(12) United States Patent
Crawford et al.

(10) Patent No.: US 8,578,857 B2
(45) Date of Patent: Nov. 12, 2013

(54) AMUSEMENT PARK RIDE WITH PASSENGER LOADING SEPARATED FROM VEHICLE INSERTION INTO SIMULATORS

(75) Inventors: David W. Crawford, Long Beach, CA (US); Edward A. Nemeth, Hermosa Beach, CA (US); Brian E. Crosby, Cypress, CA (US); Christopher L. Beatty, Pasadena, CA (US)

(73) Assignee: Disney Enterprises, Inc., Burbank, CA (US)

( * ) Notice: Subject to any disclaimer, the term of this patent is extended or adjusted under 35 U.S.C. 154(b) by 172 days.

(21) Appl. No.: 13/315,017

(22) Filed: Dec. 8, 2011

(65) Prior Publication Data

US 2013/0145953 A1 Jun. 13, 2013

(51) Int. Cl.
*A63G 1/00* (2006.01)

(52) U.S. Cl.
USPC ..... 104/83

(58) Field of Classification Search
USPC ..... 104/53, 58–60, 63, 83–86
See application file for complete search history.

(56) References Cited

U.S. PATENT DOCUMENTS

| | | | |
|---|---|---|---|
| 4,976,438 | A | 12/1990 | Tashiro et al. |
| 5,192,247 | A | 3/1993 | Barr et al. |
| 5,382,026 | A | 1/1995 | Harvard et al. |
| 5,507,647 | A | 4/1996 | Morris |
| 5,547,382 | A | 8/1996 | Yamasaki et al. |
| 5,623,878 | A | 4/1997 | Baxter |
| 5,716,281 | A | 2/1998 | Dote |
| 5,865,624 | A | 2/1999 | Hayashigawa |
| 5,951,404 | A | 9/1999 | Oishi et al. |
| 6,007,338 | A | 12/1999 | DiNunzio et al. |
| 6,024,647 | A | 2/2000 | Bennett et al. |
| 6,079,982 | A | 6/2000 | Meader |
| 6,095,926 | A | 8/2000 | Hettema et al. |
| 6,220,965 | B1 * | 4/2001 | Hanna et al. ..... 463/52 |
| 6,227,121 | B1 | 5/2001 | Mares |

(Continued)

FOREIGN PATENT DOCUMENTS

EP 1403838 A1 3/2004

OTHER PUBLICATIONS

Brigante, Ricky, "Spoiler-FILLED Review: Harry Potter and the Forbidden Journey ride at Universal Orlando's Wizarding World" Universal, retrieved on Jun. 7, 2011 from http://www.insidethemagic.net/2010/06/spoiler-filled-review-harry-potter-and-the-forbidden-journey-ride-at-universal-orlandos-wizarding-world/.

*Primary Examiner* — R. J. McCarry, Jr.
(74) *Attorney, Agent, or Firm* — Marsh Fischmann & Breyfogle, LLP; Kent A. Lembke

(57) ABSTRACT

A ride system for efficiently utilizing a simulator(s) or immersive environment assembly. The ride system includes a closed-loop track and a plurality of passenger vehicles each configured for traveling along a ride path defined by the closed-loop track. The ride system includes a simulator positioned adjacent to the closed-loop track. The ride system also includes a vehicle transfer mechanism. This mechanism is typically positioned along the track (or to provide part of the track) near the simulator. In operation, the transfer mechanism receives or captures a first one of the vehicles and transfers the first vehicle a distance away from the ride path and into the simulator and its immersive entertainment environment. The transfer mechanism is configured such that a second one of the vehicles trailing the first vehicle travels along the ride path past the simulator while the first vehicle is positioned within the simulator.

32 Claims, 5 Drawing Sheets

(56) References Cited

U.S. PATENT DOCUMENTS

| | | | |
|---|---|---|---|
| 6,354,954 | B1 | 3/2002 | Sumner |
| 6,463,859 | B1 | 10/2002 | Ikezawa |
| 6,796,908 | B2 | 9/2004 | Weston |
| 6,910,972 | B2 | 6/2005 | Norbury |
| 7,094,157 | B2 | 8/2006 | Fromyer |
| 7,195,487 | B2 | 3/2007 | Robbins |
| 7,794,330 | B2 | 9/2010 | Gordon |
| 7,802,522 | B2 | 9/2010 | Gordon |
| 7,905,790 | B2 | 3/2011 | Schnuckle |
| 2004/0110565 | A1 | 6/2004 | Levesque |

* cited by examiner

AMUSEMENT PARK RIDE WITH PASSENGER LOADING SEPARATED FROM VEHICLE INSERTION INTO SIMULATORS

BACKGROUND

1. Field of the Description

The present description relates, in general, to providing amusement park rides that provide high throughput and high daily capacities. More particularly, the present description relates to a ride system that retains the many benefits of simulators but without the problems of low throughput, operational inefficiency, and ride capacity typically associated with use of single simulators.

2. Relevant Background

Amusement and theme parks continue to be popular worldwide with hundreds of millions of people visiting the parks each year. To entertain these park visitors, many parks have turned to simulators such as motion simulators. A passenger motion simulator may be used as an amusement park ride with a seating platform that may have multi-degree of freedom movement and seats 2 to 8 or more passengers for each simulation (or "ride"). A vehicle body typically has walls that wrap around the passenger seats on the seating platform to provide a projection surface(s) or block sightlines to shared projection surfaces. Prior to each simulation or ride, passengers that experienced the prior simulation must disembark and then a next group of passengers has to enter the vehicle and be arranged safely in their seats.

The movement of the platform can be combined with projected visual effects on the interior sidewalls of the vehicle body to effectively simulate motion that would be technically difficult to build and impractical due to size and other constraints to provide in a track-based ride. These simulators may be thought of as motion theaters and have been used to simulate a flying vehicle, a racing land-based vehicle, and a submarine or other vehicle moving in a liquid through movement and vibration of the seat platform (or seats) through yaw, pitch, and roll and/or other movements. The simulator may add other effects such as air flow and moisture to enhance the simulation with wind and water spray or snow to further create the illusion of fast movements. Nearly any virtual world can be created via media used to provide visual, audio, and other special effects.

By changing the media and programming used to move the seating platform or provide other effects, new "rides" or simulations presenting new worlds and adventures can be quickly achieved without requiring replacement of much if any of the physical equipment of the simulator. More recently, 3D technology has been added to simulators to further enhance the experience with the passengers typically wearing 3D glasses to view projected 3D imagery (e.g., right and left eye images or the like).

Due to the high quality of the ride experience provided by these devices, simulators have become a staple of amusement parks including theme parks. However, there are a number of limitations or problems with use of simulators. While simulators have a small footprint due to being a stationary vehicle, they typically have relatively low passenger capacity with larger simulator vehicles seating 20 to 30 or fewer passengers. Further, simulators provide relatively low utilization of the space and show equipment as passengers load and unload from a single vehicle such that the simulator is idle for a significant amount of time between operations or simulations, e.g., a second set of passengers cannot begin their experience until the prior or first set of passengers exits the vehicle. Additionally, the simulator experience has become predictable to many as simulators have become more common and are now provided outside large parks such as at malls and arcades. Also, simulators are operationally inefficient as both passengers and staff are distributed to many locations within the facility to load and unload individual simulator bays.

Hence, there remains a need for a ride system that provides high capacity or passenger throughput while making use of the desirable aspects of a simulator such as providing a small footprint, being useful for gaming or interactive opportunities, being reprogrammable to create new experiences or rides, and simulating vehicle movements and sensations through fantastical environments not practical with a conventional track-based or other physical ride system. Preferably, such a ride system would hide or disguise the use of a simulator such that many passengers would fail to perceive that they were even on a simulator. In some theme parks, it would also be desirable for the ride system to provide enhanced storytelling within the narrative or ride experience.

SUMMARY

The present description addresses the above and other problems by providing a new ride system that includes a vehicle transfer system that physically moves a vehicle, which may be configured for multi-degree freedom motion capabilities, off or away from a ride path or track into an immersive projection environment provided by a simulator assembly. The passengers may remain within the simulator for a large portion of the overall length of each ride cycle, which may equate to multiple dispatch intervals. In the ride system, the vehicle may move through a short dimensional environment for "Scene 1") after leaving the station and before integration with the simulated environment ("Scene 2" or more), which causes the passenger to believe they are on a ride rather than in a conventional, stationary simulator.

The multi-degree of freedom base may be used on the vehicle, or provided in the simulator assembly for receiving the vehicle body, to enhance the experience with vehicle motions within the simulator assembly that are coordinated with the displayed/projected visual dynamics. Vehicles may be permanently fixed to the vehicle transfer system or may be moved along the track until they are received by and/or engage the vehicle transfer system/mechanism. For example, the vehicles may travel along the track until they travel onto a platform where they are secured or simply supported, and then, via movement of the platform, they are moved into and out of the simulator assembly (e.g., projected/displayed environment). For example, the passenger vehicle may be transferred, lifted, or even lowered into the simulator assembly to achieve a desired attraction experience or to suit a storytelling or ride theme.

Many of the traditional benefits of a simulator are retained and utilized (e.g., small footprint, reprogrammable media/simulated experience, and so on). Additionally, by separating the vehicle from the simulator itself (e.g., not a stationary piece of the simulator assembly), passenger loading and unloading may occur in a dedicated station, independent of the simulator environment and simulator. This results in a much higher utilization of the simulator and its assets as well as simplified load/unload scenarios that require less personnel. For example, turn over time is only limited by the time it takes to move one vehicle (or set of vehicles when a train is moved in and out of one or more simulator bays/pods) out of a simulator assembly and a next vehicle in.

More particularly, a ride system is provided that efficiently utilizes a simulator(s). The ride system includes a closed-loop track and a plurality of passenger vehicles each configured for traveling along a ride path defined by the closed-loop track. The ride system also includes a simulator positioned adjacent to the closed-loop track, which is configured to provide an immersive entertainment environment. The ride system also includes a vehicle transfer mechanism. This mechanism is typically positioned along the track (or to provide part of the track) near the simulator. In operation, the transfer mechanism receives or captures a first one of the vehicles and transfers the first vehicle a distance away from the ride path and into the simulator (at which point the simulator may operate to provide a simulation).

Further, the transfer mechanism is configured such that a second one of the vehicles trailing the first vehicle travels along the ride path past the simulator while the first vehicle is positioned within the simulator. For example, the second vehicle may be exiting an upstream simulator or may be progressing toward a downstream simulator in ride systems where multiple simulators are provided for concurrent use by vehicles. In some cases, the vehicles each may include a multi-degree of freedom base, and the simulator may then include an actuator selectively actuating the vehicle base while positioned within the simulator. The simulator use is made more efficient by having the ride system include a passenger loading and unloading station positioned along the closed-loop track a distance away from the simulator, such that the second vehicle is loaded or unloaded while or after the first vehicle is transferred into the simulator.

The transfer mechanism may take a number of forms to practice the invention. For example, the vehicle transfer mechanism may include a transfer table operable to move a received one of the vehicles horizontally away from the closed-loop track into the simulator. In other cases, the transfer mechanism may include a turntable with a first track section for receiving the first vehicle and a second track section for guiding the second vehicle along the ride path when the turntable is rotated to transfer the first vehicle into the simulator. In other cases, though, the transfer mechanism may include a lift device for lifting or lowering the received first vehicle the distance away from the ride path and a second track section for guiding the second vehicle along the ride path.

DETAILED DESCRIPTION

Embodiments of the present description are directed to ride systems that are configured to more effectively, with higher throughput and overall capacity, make use of simulators. Briefly, the ride systems each provide one or more simulators or simulator assemblies that are positioned along a track (e.g., a vehicle track defining a closed loop) at a first location. The simulator assemblies differ from prior simulators in that they do not include a vehicle and passenger seats (or a seating platform). Instead, the ride systems each include vehicles that are loaded and unloaded at a station that is located at a second location spaced apart from the first location and apart from the simulator assembly.

During operations, passengers load and unload from the vehicles at the stations, and then the vehicles travel along the track toward the simulator assembly or assemblies. A theme or storytelling portion of the ride may be provided between the station and the simulators. The ride system also includes a vehicle transfer mechanism (e.g., one per simulator or the like) that operates to transfer a loaded passenger vehicle from the track into one of the simulator assemblies. The simulator is then operated with the received or "plugged in" vehicle within the simulator.

Each vehicle may include a multi-degree of freedom base or actuable seats or seating platform, and the simulator may include a base (or seat/seat platform) actuator that operates in conjunction with projected media and other effects to simulate motion or other experiences with the simulator (e.g., as is common with simulators using stationary or built-in or fixed passenger vehicles or seating platforms). After the simulation is complete, the vehicle transfer mechanism is again operated to remove the passenger vehicle from the simulator and return it to the track or closed loop ride path, such that it can continue to travel back to the station for unloading and then loading operations. While this vehicle is traveling and unloading/loading, the simulator may be utilized by other vehicles. Hence, the simulator is much more efficiently utilized relative to prior simulators as loading and unloading occurs apart from the simulator and because the simulator can be used again as soon as vehicles can be swapped (unloaded and loaded) by the vehicle transfer mechanism.

Figure 1:
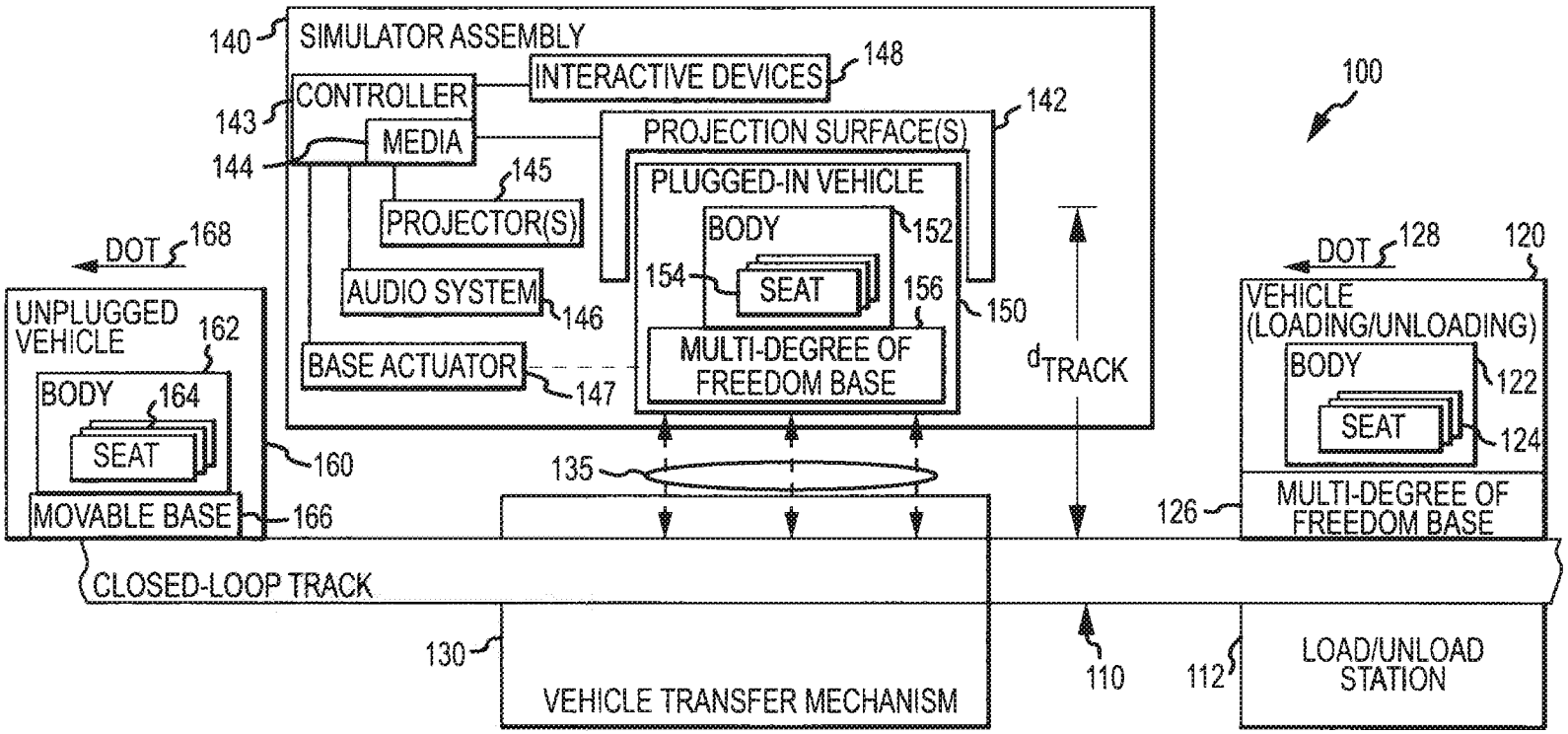
FIG. 1 is a functional block or schematic drawing of a simulator-based ride system of the present description.

FIG. 1 illustrates a simulator-based ride system 100 of one embodiment of the invention. As shown, a closed-loop track 110 is included for defining a ride path for a plurality of passenger vehicles, and the ride path may be along one or more thematic or storytelling portions as commonly found in theme park rides. The ride system 100 includes a load and unload station 112 adjacent or along a section of the track 110, and passengers (not shown) enter moving or stopped vehicles in the station 112 at the start of a ride (operation of ride system 100) and exit or debark from moving or stopped vehicles in the station 112 at the end of the ride. Each ride cycle includes a simulation or simulated motion/ride experience provided by a simulator assembly 140 of the ride system 100. In other words, a passenger vehicle travels from the station 112 to the simulator assembly 140 where it is plugged into the assembly 140 (taken off of track 110) for a simulation (motion theater or other experience) and then later returned to the track 112 to travel back to the station 112 for unloading.

The ride system 100 is shown to include three passenger vehicles 120, 150, 160 (although more vehicles typically would be included in a system 100) at differing stages of operation of the ride system 100. The first vehicle 120 is shown at the station 112 for unloading of passengers and loading of a new set of passengers. The vehicle 120 includes a body or platform 122 which is mounted upon a multi-degree of freedom base 126 (for separate movement or for moving with base 126). Once loaded, the vehicle 120 is caused by the system 100 to move along a ride path defined by the track 110 toward a simulator assembly 140. Along the track 110 between the station 112 and the simulator assembly 140, the ride 100 may include show or theme elements to entertain the passengers and/or to tell a portion of a story (e.g., provide build up for the experience provided by the simulator assembly 140). The simulator assembly 140 typically will be a distance from the station 112 that will vary with implementations of ride system 100 but will typically be chosen such that a next vehicle 120 moving at a particular velocity 128 from the station 112 arrives at the location of the simulator assembly 140 as or soon after a prior vehicle is removed from the assembly 140 by vehicle transfer mechanism 130.

The simulator assembly 140 is shown to include one or more projection or display surfaces 142 such as may be provided by a shell or enclosure in which vehicles 120, 150, 160 may be inserted or positioned (e.g., plugged in) for passengers to view, hear, and otherwise experience effects provided during operation of the simulator assembly 140. The ride system 100 includes a vehicle transfer mechanism 130 for moving (as shown with arrows 135) each vehicle from the track 110 into and out of the simulator assembly 140 near or within the projection surface 142.

As shown, a vehicle 150 with a body 152, passenger seats 154, and a multi-degree of freedom base 156 has been moved a distance, $d_{Track}$, from the track 110 (or ride path) to place it within the simulator assembly 140. After a simulation is complete, the transfer mechanism 130 is again operated to move 135 the vehicle 150 back out of the simulator assembly 140 and onto the track 120 to return to the station 112. This is shown with the unplugged vehicle 160 (again, with a body/platform 162, seats 164, and movable base 166) that is traveling 168 in a direction of travel along the track 110 that returns it via the closed-loop path to the station.

The simulator assembly 140 may take many forms to practice the invention, but it generally is configured to utilize media that may be coordinated with other devices (such as wind generators, water sprayers, vibrators, and the base actuator 147) to simulate motion and other experiences while the vehicle 150 is docked or plugged into the assembly 140. To this end, the simulator assembly 140 includes the projection surfaces 142 that may extend about a received vehicle 150. A controller 143 may be used to control operation of one or more projectors/display devices 145 such as by projecting/displaying videos or other media 144. The controller 143 may use this media or other programming to coordinate operation of the projectors 145 with an audio system 146 and other special effects.

To selectively provide motion, the controller 143 may operate a base actuator 147 to cause movement of the base 156 (or seats 154 directly), and the actuator 147 may be provided on the vehicle 150 or connect/link with the base 156 but be provided with the assembly 140. By such actuation, the base 156 and seats may be moved in one, two, three, or more directions and/or be vibrated to simulate motion that is coordinated with media 144. The simulated experience may be interactive such that passengers in seats 154 may provide input with interactive devices 148 (that, again, may be provided at least in part on the vehicle 150 and/or at the simulator assembly 140), and the controller 143 may process this passenger input to modify the simulation. The length of the simulation is selected such that the plugged-in vehicle 150 is ejected or removed 135 from the simulator assembly 140 by the vehicle transfer mechanism 130 when or immediately prior to arrival of the next vehicle 120 such that the vehicle 120 can be plugged into the simulator with no or little delay period. In this manner, the simulator assembly 140 may, in some embodiments, only be idle during operation of the ride system 100 for about the time required to remove one vehicle 150 and insert another vehicle 120 by the transfer mechanism 130.

As can be seen from the ride of FIG. 1, the inventors have created a new ride system that includes a vehicle transfer system that physically moves a vehicle (with multi-degree freedom motion capabilities) into an immersive projection environment. The passengers may remain within the simulator for a large portion of the overall length (time period) of each ride cycle and may account for multiple dispatch intervals, then proceed to load/unload the vehicles and to plug in and eject vehicles from the simulator assembly (or immersive projection environment). An important emotional aspect of the ride system is that the vehicle moves through a short dimensional environment (or "Scene 1") after leaving the station and before integration with the simulated environment ("Scene 2" or more). This acts to break the passenger's perception that they are simply on a conventional, stationary simulator.

The simulated environment can be projected or provided on a digital display in the simulator assembly. It is typically media-based such that it can be re-programmed and/or controlled to react to passenger actions, e.g., interactivity provided such as within a video game environment. The vehicle may have interactive devices that allow for cooperative or individual interaction with the projected/displayed environment. A multi-degree of freedom motion base may be used (on the vehicle or provided in the simulator assembly for receiving the vehicle body) to enhance the experience with vehicle motions within the simulator assembly that are coordinated with the displayed/projected visual environments.

Vehicles may be permanently fixed to the vehicle transfer system or may be moved along the track until they are received by and/or engage the vehicle transfer system/mechanism. For example, the vehicles may travel along the track until they travel onto a platform where they are secured or simply supported, and then, via movement of the platform, they are moved into and out of the simulator assembly (e.g., projected/displayed environment). For example, the passenger vehicle may be transferred, lifted, or even lowered into the simulator assembly to achieve a desired attraction experience or to suit a storytelling or ride theme.

Since there is passenger-perceived physical motion of the vehicle before and after the simulator-provided experience (in which the vehicle has no or little travel along the ride path defined by the track), a passenger interprets the ride provided by the described ride systems as more of a physical ride experience than a simulator experience. However, many of the benefits of a simulator are retained and utilized (e.g., small footprint, reprogrammable media/simulated experience, and so on). Additionally, by separating the vehicle from the simulator itself (e.g., not a stationary piece of the simulator assembly), passenger loading and unloading may occur independent of the simulator environment at a single dedicated station, instead of at multiple simulator locations. This results in a much higher utilization of the simulator and its assets. For example, turn over time is only limited by the time it takes to move one vehicle (or set of vehicles when a train is moved in and out of one or more simulator bays/pods) out of a simulator assembly and a next vehicle in.

Figure 2:
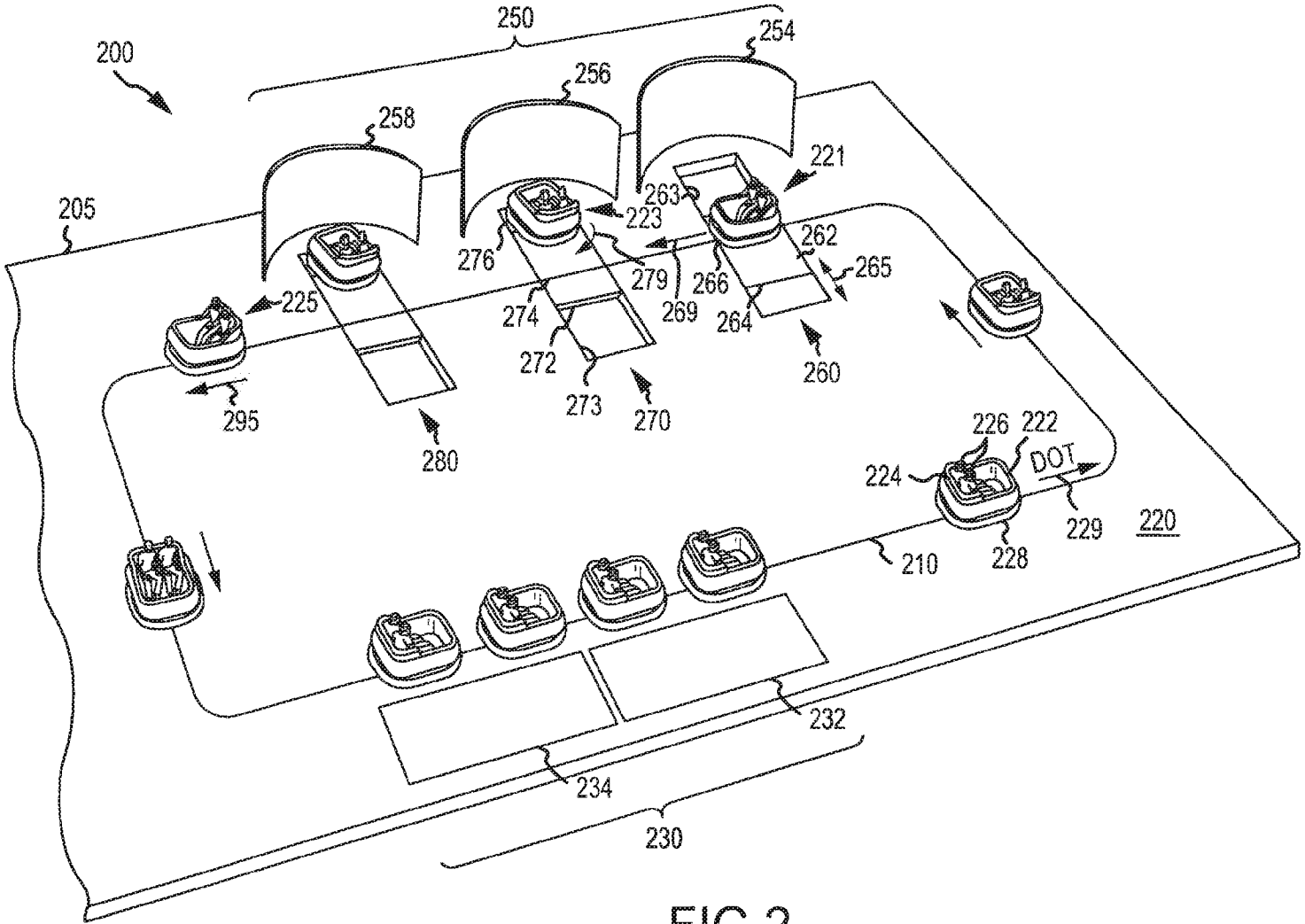
FIG. 2 illustrates a perspective overhead or top view of another embodiment of a simulator-based ride system of the present description showing use of a linear moving (or sliding) transfer table for plugging vehicles into simulator bays.

FIG. 2 illustrates a perspective top view of a ride system 200 according to another embodiment of the invention. The ride system 200 may include components of system 100 of FIG. 1 (such as those in simulator assembly 140) and is simplified for ease of discussing its key aspects. As shown, the ride system 200 includes a ride platform 205 that may be used to support vehicles (such as vehicle 220) as they travel along a track or ride path 210 (defined by a track, not shown, under the platform 205) and also to support other ride system 200 components.

The ride system 200 includes a station area 230 with a load platform 232 and an unload platform 234 allowing passengers to embark/load and disembark/unload, respectively, from vehicles. To this end, the system 200 includes a plurality of passenger vehicles that travel along the ride path 210, and the vehicles may take many forms to practice the system 200. For example, vehicle 220 is shown after loading from the platform 232 in station 230. The vehicle 220 includes a body 222 with a number of seats 224 for passengers 226 (shown as two but could be 1 to 8 or more seats per vehicle).

In this embodiment, the vehicle 220 also includes a multi-degree of freedom base 228 that can be actuated to move the body 222 (or directly moving the seats 224) when the vehicle 220 is docked or plugged into a simulator assembly (such as a bay 254, 256, 258 of simulator assembly 250). Such movement occurs when the base 228 is stationary (not moving linearly along track path 210) and acts to move the body 222 (e.g., in a motion theater or the like via yaw, pitch, roll, vibration, and so on). The vehicle 220 is shown moving in a direction of travel (DOT) at a velocity 229 away from station 230, e.g., through a first scene (Scene 1) where the passengers 226 may view show elements or the like as part of a storytelling theme that sets up the simulation provided by assembly 250. The vehicle drive devices for moving the vehicle 220 along the track path 210 may take nearly any form to practice the invention and are not limiting to the invention.

The ride system 200 also includes a simulator assembly 250 that is configured to concurrently provide simulation experiences (e.g., motion theater-type experiences or the like). To this end, the simulator assembly 250 includes a plurality of simulator bays or stations 254, 256, 258 that are arranged in a side-by-side manner along or adjacent to a length of the track path (or a track defining such a path for vehicles such as vehicle 220). Each bay 254, 256, 258 may include one or more projection or display screens and audio and other effect equipment to provide an immersive environment, with a single wrap around display shown as one non-limiting example of how to implement the system 200. The simulator assembly 250 would be operable to selectively play media to provide a simulation experience when a vehicle has been inserted or plugged into a bay such as bays 256 and 258 in FIG. 2.

To provide the plug in (and eject) aspects of the invention, the ride system 200 includes a vehicle transfer mechanism 260, 270, 280 for each simulator bay 254, 256, 258. In this embodiment, the transfer mechanisms 260, 270, 280 are provided in the form of a transfer table that can slide linearly in and out of the bays 254, 256, 258 so as to cause a received vehicle to move in and out of simulator assembly 250 and also to allow non-captured vehicles to pass this area on the track path 210.

As shown, a vehicle 221 may be traveling along the track path 210 in the direction of travel until it is positioned on the table body 262. The table body 262 may have an inner/first track (or groove or track section) 266 and an outer/second track (or groove or track section) 264. In this way, a vehicle 221 may travel over and past the table body 262 as shown with arrow 269 when the table body 262 is in an extended position (out of bay 254) or inserted/plugged in position (in bay 254). This allows vehicles to pass bays 254, 256, 258 until they arrive at one designated for receiving that particular vehicle (e.g., to arrive at a bay for use in simulation or to return to the station 230 as shown with vehicle 225 and arrow 295). In this way, the simulator assembly 250 can be operated in a manner that is coordinated with dispatches from the platform 232 and travel time along the track path 210 upstream from simulator assembly 250 to keep the bays 254, 256, 258 occupied and operating on an ongoing basis.

The transfer mechanism 260 is shown to be seated or supported within a slot or groove 263 in the ride platform 205 and to be in an extended or out position. In this position, the vehicle 221 may be received or "captured" by (or simply halted upon) the table body 262 as it travels on inner track or slot 266. As shown with arrow 265, the transfer mechanism 260 is adapted with an actuator, a motor, and/or other devices to slide the body 262 linearly in and out of the bay 254. Such sliding is shown with transfer mechanism 270, which includes a table body 272 in groove/slot 273, and a vehicle 223 received or captured in its inner/first groove or slot 276.

The table body 272 is shown in the inserted or in (or plugged in) position with the inner track 276 and captured vehicle 223 positioned proximate or adjacent within bay 256 (or the wraparound display/projection screen(s) 256). Vehicles such as vehicle 221 may freely pass the table body 272 with the table body 272 in the in or inserted position via outer/second track or slot 274 that is positioned to define a portion of the track path 210. It is then possible for the vehicle to rotate itself to face the simulated environment or the transfer mechanism 270 to function to rotate 279 the body of vehicle 223 about 90 degrees to face the screen in bay 256, and other amounts of rotation may be provided by devices in the table body 272 or elsewhere in mechanism 270 to reorient the vehicle 223 from a ride travel orientation for use on track path 210 (as shown with vehicles 220, 221, and 225) to a simulation orientation(s).

In one embodiment, the rotation 279 is provided gradually as the linear movement of table body 272 in groove 273 (e.g., rotation 279 is proportional and matched to linear travel of body 272) while in other cases the rotation may occur after the table body 272 is moved into the inserted or in position. After a simulation is completed by simulator assembly 250 such as in bay 256, the transfer mechanism 270 operates in reverse manner to move the table body 272 and captured/received vehicle 223 back to the extended/first position with track 276 aligned with or in the track path 210. The vehicle 223 is then released and is moved onward along the track path 210 such as is shown for vehicle 225 moving 295 in a direction of travel towards the station area 230 for passenger unloading onto the unload platform 234. The bay 256 is vacant for a short period until a next vehicle such as vehicle 220 is captured or received by the table body 272 for plugging into the bay 256 with its immersive environment (e.g., wraparound screens or the like).

Figure 3:
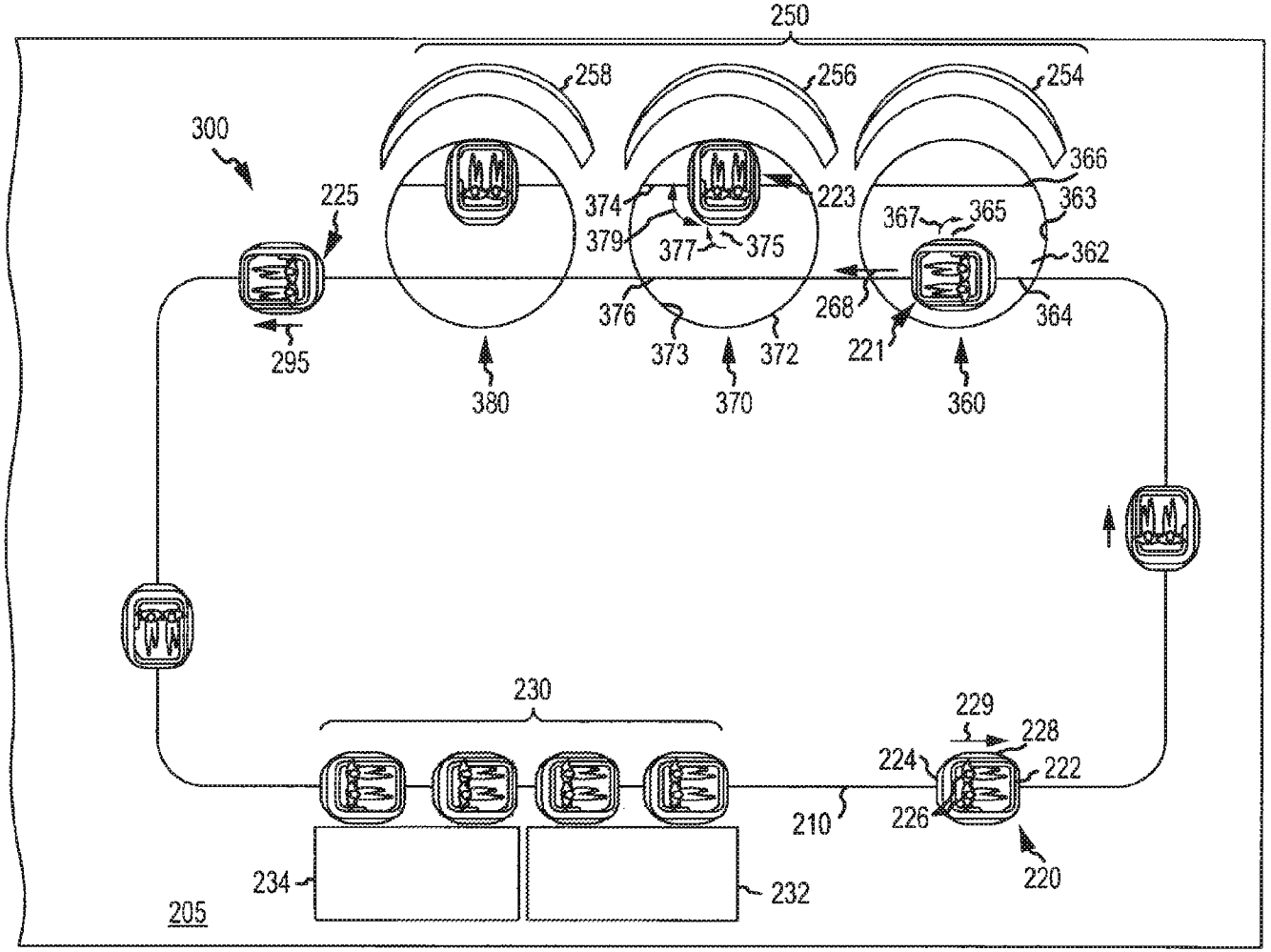
FIG. 3 illustrates an overhead or plan view of an embodiment of a simulator-based ride system similar to that of FIG. 2 but with differing vehicle transfer mechanisms.

FIG. 3 is a plan view of a ride system 300 that is arranged similarly to the system 200 of FIG. 2, and the similar components are labeled with like numbers and not described again in detail here. The ride system 300 differs from system 200 because it utilizes differing vehicle transfer mechanisms 360, 370, 380 for bays 254, 256, 258 to plug vehicles into the simulator assembly 250. Instead of a linear-sliding transfer table, the mechanisms 360, 370, 380 are configured to utilize a turntable or rotating platform to selectively position passenger vehicles or to rotate the vehicles off of the track path 210 a distance and into an immersive environment of the simulator assembly 250.

As shown, the vehicle transfer mechanism 360 includes a platform or turntable 362 in the recess or circular opening 363 of ride platform 205. The turntable 362 includes a first track or slot 364 for receiving a vehicle 221, and the vehicle 221 may continue 269 past the bay 254 in this position of the turntable 362 (e.g., an "out" or unplugged position). The track 364, though, often will be used to receive and capture the vehicle 221 for insertion into the bay 254, and this involves the platform 362 rotating 367 about a central or rotation axis 365, such as with an actuator or motor rotating a shaft attached to the bottom of the platform 362. The platform or turntable 362 also includes a second track or slot for receiving vehicles and allowing such vehicles to pass along the track path 210 (e.g., when vehicle 221 is plugged into bay 254 additional passing vehicles are allowed to pass by the bay 254 to an open or available bay or immersion environment 256 or 258 of the simulator assembly 250).

As shown, the transfer mechanism 370 also includes a turntable 372 in a circular opening or recess 373 of ride platform 205. The mechanism 370 also includes a first track or slot 374 in platform 372 that is shown to have received and captured vehicle 223. The turntable 372 also includes a second track or slot 376 that is positioned in the track path 210 when the turntable 372 is turned or rotated 377 into the plugged in position or orientation (rotated 180 degrees in this embodiment of system 300). As shown, the track 374 with vehicle 223 is repositioned such that vehicle 223 is proximate or adjacent to the display/projection screen of the immersive environment provided by bay 256 (or vehicle 223 is inserted or plugged into the bay 256 of simulator 250).

As part of the rotation of platform 372, the vehicle 223 is counter rotated 279 such that the vehicle body is facing a desired direction to allow passengers to better view displayed images in the immersive environment. In other cases, though, the bay 256 may simply be configured to receive the vehicle 223 in the original orientation within the first track/slot 374. When a simulation is completed, the turntable 372 is rotated by the transfer mechanism 370 back to its original position (out state or position) with track 374 aligned with or part of the track path, and the vehicle 223 is released or caused to move away as shown with departing vehicle 225 with arrow 295 indicating the vehicle 225 is moving away from the simulator assembly 250 back to the station 230 for unloading at unload platform 234 and then loading at load platform 232. This system has the advantage of a simultaneous transfer when two vehicles are parked on the turntable. In this situation, a vehicle can be moved into the simulation environment at the same time as another vehicle is removed further decreasing the time the simulation environment is not active.

In the above two examples, the passenger vehicles included bodies with one to eight or more seats for passengers. In other cases, a train of cars (a "vehicle") each carrying one or more passengers may travel be loaded at a station and dispatched along a closed-loop track. In such ride systems, the vehicle transfer mechanism would function to capture a train of such cars and selectively move the train away or off the track and plug it into a simulator assembly. The simulator assembly may include a large bay or immersion environment for receiving all the cars or may include separate bays or stations for each car, with the cars being rotated as desired to have an orientation that suits the display/projection screen(s).

For example, a train of cars in the form of single passenger devices (cycles or the like) may travel as a unit along a first length of track to view and experience a first dimensional scene (or more scenes) that sets up a later simulation experience. Then, the train of cars may be advanced and received on a transfer table (linear sliding, turntable, lift device, or the like) and moved by a transfer mechanism into an awaiting simulator assembly. Individual stations or booths are provided to immerse each car into their own simulator (e.g., a wraparound motion theater or the like). The train would then be moved back onto the track by the transfer mechanism to return to the station for unload/load operations. In one such design, the ride system was able to service 500 vehicles per hour using 8 trains moving along a closed-loop track with five simulator assemblies and five corresponding transfer tables. In this exemplary design, dispatches occurred about every 40 to 45 seconds and the simulators each provided a simulation lasting 3 to 4 minutes (e.g., a 3.5 minute-long video cycle or the like).

Figure 4:
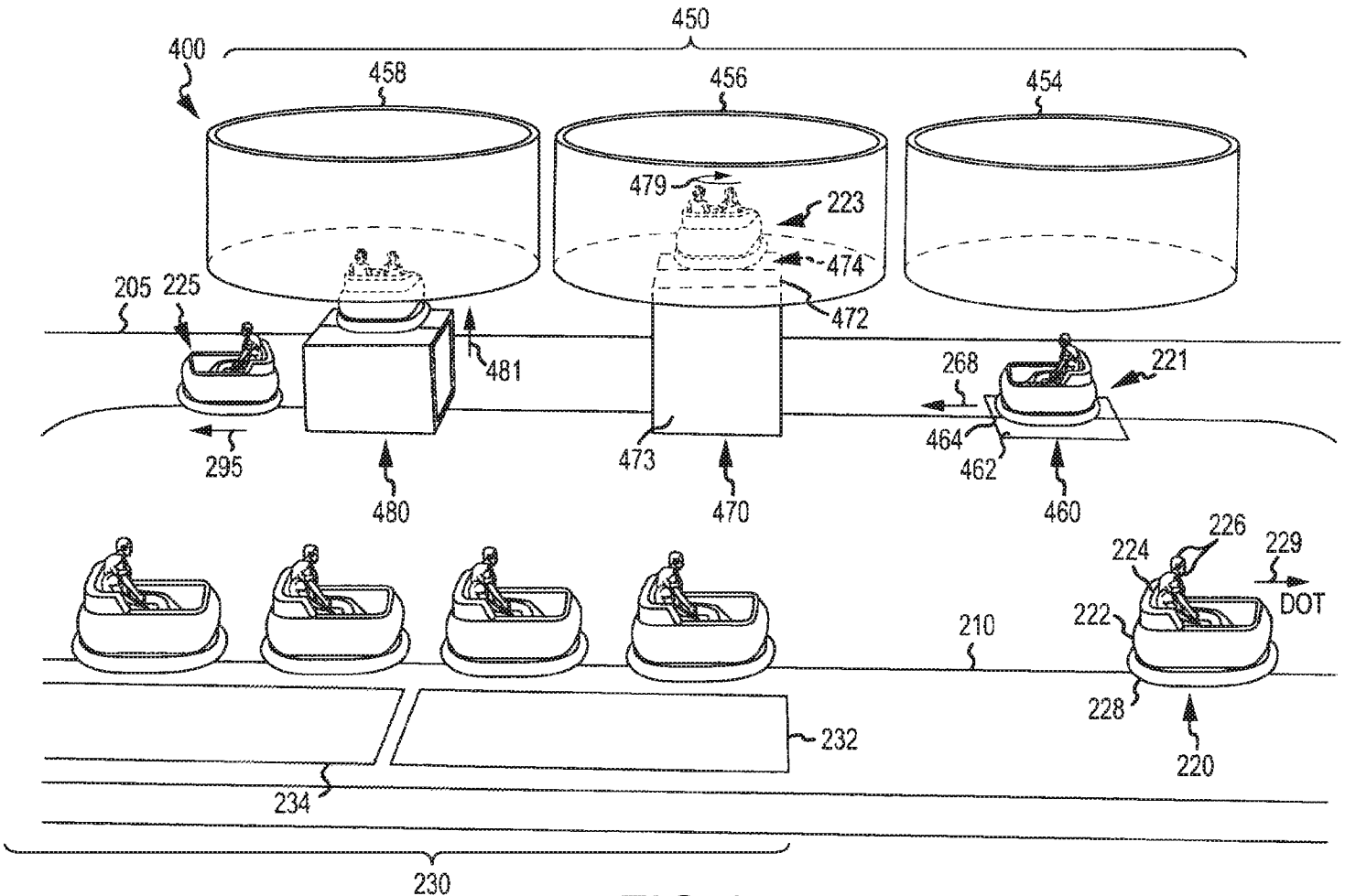
FIGS. 4 and 5 illustrate side perspective views of another embodiment of simulator-based ride system similar to those shown in FIGS. 2 and 3 but with yet another exemplary vehicle transfer mechanism for selectively positioning vehicles within an immersive environment of a simulator.
Figure 5:
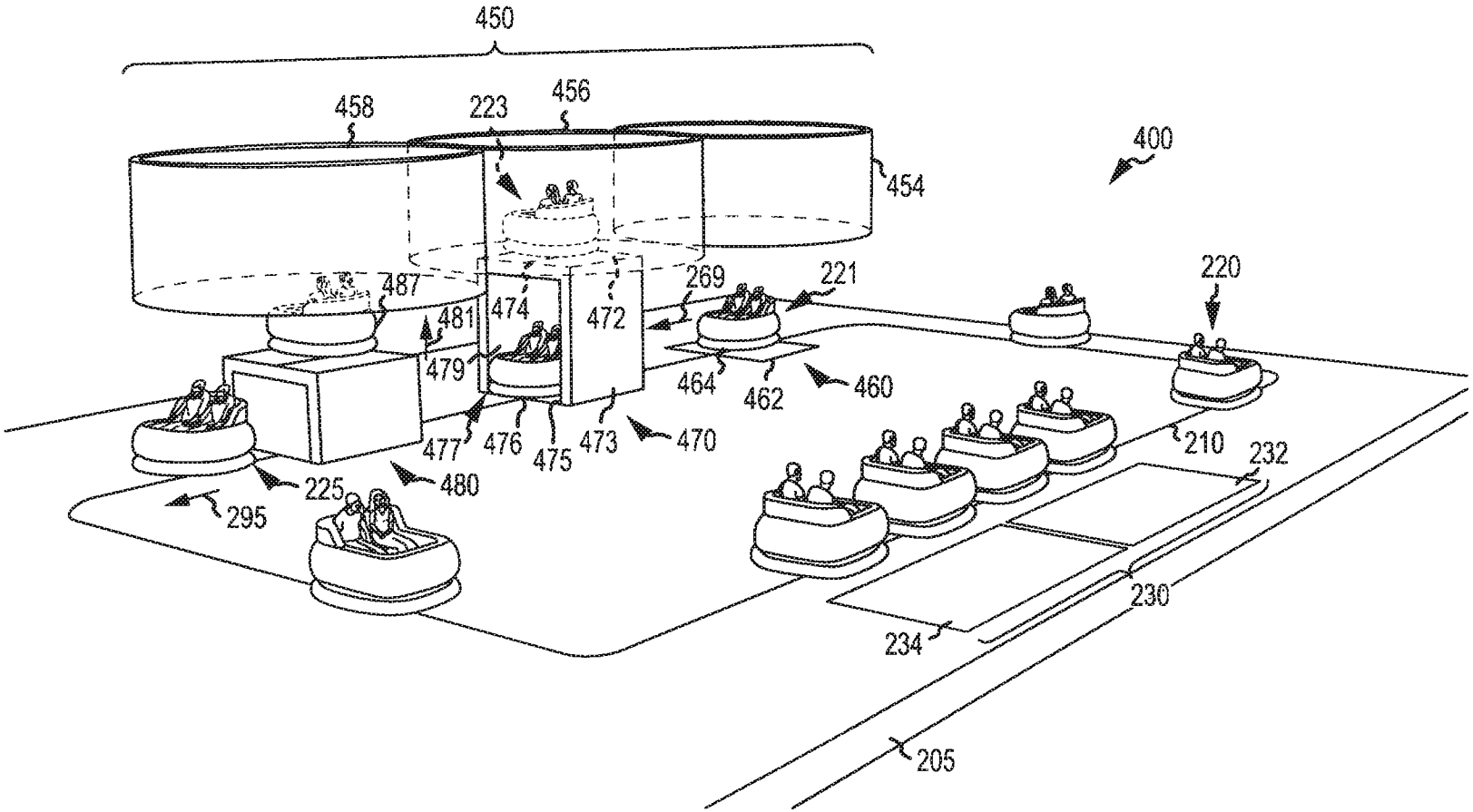

FIGS. 4 and 5 illustrate a ride system 400 that is similar to the systems 200 and 300 but that provides vehicle lifts or elevators to position vehicles within immersive environments. Specifically, as shown, the ride system 400 includes a simulator assembly 450 that includes a number of simulator bays or stations 454, 456, 458 that may take the form of elevated screens located a vertical distance above the ride platform 205. For example, each may take the form of a cylindrical display/projection surface in which a vehicle may be positioned to provide a surround-type simulation experience.

The ride system 400 includes a vehicle transfer mechanism 460, 470, 480 paired to each simulator bay or station 454, 456, 458. These mechanisms 454, 456, 458 may take the form of vehicle lifts or elevators provided along the track path 210. As shown, the mechanism 454 is in the down or unplugged position, and it includes an upper platform 462 with a track/slot 464 for receiving a vehicle 221. The vehicle 221 may be moved 269 over the upper platform 462 to return to the station 230 (such as after a simulation in bay 454) or to move on to another available bay 456, 458. The mechanism 470 is shown in an up or plugged in position, and it includes an upper platform 472 for supporting a vehicle 223 received/captured in track/slot 474. The elevator mechanism 470 may be adapted such that the upper platform 472 rotates or reorients the vehicle 223 as it rises upward into the bay 456 and as it is later lowered back down to the platform 205. In other cases, the rotation mechanism may be part of the vehicle itself.

The transfer mechanism 470 is shown to include sidewalls 473 that support the upper platform 472 and define an opening or passageway 479. The mechanism 470 includes a lower platform 475 with a track or slot 476 such that a vehicle 477 may continue along the track path 210 (e.g., the track 476 defines a portion of the path 210) rather than being captured by mechanism 470 when it is in the up or plugged in position (e.g., bay 456 is already in use). This allows the vehicle 477 to be moved along to the next vehicle transfer mechanism 480 or to return to the station 230 for unloading at platform 234 as shown with vehicle 225 by arrow 295. The mechanism 480 is shown in transition from the down position to the up position so as to plug in the captured and supported vehicle 487. In some embodiments, the simulation bays/stations 454, 456, 458 are located below the ride platform/surface 205 such that the elevators/mechanisms 460, 470, 480 act to lower the vehicles to plug them into simulator assembly 450 rather than lifting them as shown in ride system 400.

Although the invention has been described and illustrated with a certain degree of particularity, it is understood that the present disclosure has been made only by way of example, and that numerous changes in the combination and arrangement of parts can be resorted to by those skilled in the art.

As described a plug-in simulator ride system is taught that allows a vehicle to move into and out of an immersive projected/displayed environment. The system includes a passenger carrying vehicle that moves along a defined path or track and allows for passenger loading and unloading in a single station area. The system further includes an immersive projection environment (e.g., a simulator with a projection shell or enclosure) that is located adjacent to the track path and separate from the loading area. The projection environment typically surrounds or immerses the plugged-in vehicle in order to deliver a projected or displayed presentation of the simulation or simulated environment, which the ride designers wish the passengers to perceive they are passing through as part of the ride experience.

The ride system also includes a vehicle transfer mechanism that temporarily connects or receives the vehicle and then operates to move the vehicle into and out of the projection environment. In some embodiments, the vehicle and the transfer mechanism remain connected for the duration of the simulated experience (e.g., the vehicle remains on a platform or turntable until the simulator has run a full simulation or the like). A control, power, and communication system/assembly may be provided in the ride system to manage vehicle motion, projection/displaying (selectively operate the simulator assembly), and the integration of the vehicle into and out of the simulator assembly (and projection environment).

In the ride system, the vehicle may include a multi-degree of freedom motion base that can change the position or orientation of the vehicle body, seat platform, and/or seat positions when the vehicle is positioned in the simulator assembly. In other embodiments, the vehicle motion base is provided as part of the vehicle transfer mechanism, which positions, orients, and retains the vehicle within the projection environment of the simulator assembly. The vehicle may be driven or moved onto and secured to a portion of the vehicle transfer mechanism (e.g., roll or glide along a track onto a component of the transfer mechanism). For example, the vehicle transfer mechanism may include an X or Y transfer table for receiving a vehicle that is operable to transfer the received vehicle from the track into (and back out of) the simulator assembly. In other cases, though, the vehicle may move onto a lift system that can move the vehicle vertically up or down to be spaced apart from the track and in the simulator assembly. In still other cases, the vehicle transfer mechanism may include a robotic arm or similar device that has a capture assembly for selectively capturing the vehicle moving on the track and positioning it in and out of the simulator assembly.

As will be appreciated, there are a number of differences between the ride systems described herein and conventional simulators. First, vehicles travel along a closed or looping circuit along a defined path, which allows loading and unloading to occur at a single location apart from the simulator and allows one or more scenes or non-simulator-based experiences to be provided prior to and/or after the simulation experience. A vehicle transfer mechanism (or system/assembly of such mechanisms) acts to move vehicles into an immersive projection environment that is adjacent but, typically, spaced a distance apart from the track (e.g., 5 to 20 feet or more away to allow, in some cases, other vehicles to pass along the adjacent track during operation of the simulator with a vehicle plugged into the projection environment) and also from the load/unload station (e.g., 50 or more feet away to provide a length of track for providing a pre-simulator scene or ride experience).

The simulated experience may last for a single dispatch interval such as when only one simulator is provided in a ride system. However, typically, a ride system will include two, three, or more simulators such that the simulated experience may have a duration (or last) matching two, three, or more dispatch intervals yet still eject a vehicle prior to receipt of a next serviced vehicle. During operation of the ride system, vehicles move along the track to positions outside of the motion envelope defined by a vehicle transfer mechanism. In this manner, a vehicle engages and disengages from a transfer mechanism and travels along the length of the track upstream and downstream from a simulator during each ride cycle.

We claim:

1. A ride system, comprising:

a closed-loop track;

a plurality of vehicles configured for traveling along a ride path defined by the closed-loop track;

a simulator positioned adjacent to the closed-loop track; and a vehicle transfer mechanism receiving a first one of the vehicles and transferring the first vehicle a distance away from the ride path and into the simulator, wherein a second one of the vehicles trailing the first vehicle travels along the ride path past the simulator while the first vehicle is positioned within the simulator and wherein the vehicle transfer mechanism comprises a transfer table operable to move a received one of the vehicles horizontally away from the closed-loop track into the simulator.

2. The system of claim 1, wherein the vehicles each includes a multi-degree of freedom base and the simulator includes an actuator selectively actuating the vehicle base while positioned within the simulator.

3. The system of claim 1, further comprising a passenger loading and unloading station positioned along the closed-loop track a distance away from the simulator, wherein the second vehicle is loaded or unloaded after the first vehicle is transferred into the simulator.

4. A ride system, comprising:

a closed-loop track;

a plurality of vehicles configured for traveling along a ride path defined by the closed-loop track;

a simulator positioned adjacent to the closed-loop track; and a vehicle transfer mechanism receiving a first one of the vehicles and transferring the first vehicle a distance away from the ride path and into the simulator, wherein a second one of the vehicles trailing the first vehicle travels along the ride path past the simulator while the first vehicle is positioned within the simulator and wherein the vehicle transfer mechanism comprises a turntable with a first track section for receiving the first vehicle and a second track section for guiding the second vehicle along the ride path when the turntable is rotated to transfer the first vehicle into the simulator.

5. The system of claim 4, wherein the vehicles each includes a multi-degree of freedom base and the simulator includes an actuator selectively actuating the vehicle base while positioned within the simulator.

6. The system of claim 4, further comprising a passenger loading and unloading station positioned along the closed-loop track a distance away from the simulator, wherein the second vehicle is loaded or unloaded after the first vehicle is transferred into the simulator.

7. A ride system, comprising:

a closed-loop track;

a plurality of vehicles configured for traveling along a ride path defined by the closed-loop track;

a simulator positioned adjacent to the closed-loop track; and a vehicle transfer mechanism receiving a first one of the vehicles and transferring the first vehicle a distance away from the ride path and into the simulator, wherein a second one of the vehicles trailing the first vehicle travels along the ride path past the simulator while the first vehicle is positioned within the simulator and wherein the vehicle transfers mechanism comprises a lift device for lifting or lowering the received first vehicle the distance away from the ride path and a second track section for guiding the second vehicle along the ride path.

8. The system of claim 7, wherein the vehicles each includes a multi-degree of freedom base and the simulator includes an actuator selectively actuating the vehicle base while positioned within the simulator.

9. The system of claim 7, further comprising a passenger loading and unloading station positioned along the closed-loop track a distance away from the simulator, wherein the second vehicle is loaded or unloaded after the first vehicle is transferred into the simulator.

10. A simulator-based amusement park ride, comprising:

a track;

passenger vehicles moving on the track at a first speed;

a simulation assembly configured to present a simulation to at least one of the passenger vehicles while positioned within a simulation space located apart from a ride path defined by the track; and a mechanism for transferring at least one of the passenger vehicles from the track to the simulation space, wherein the transferring mechanism comprises a body for first receiving the at least one of the passenger vehicles and second moving the at least one of the passenger vehicles out of the ride path defined by the track into the simulation space, whereby another one of the passenger vehicles may pass by the simulation assembly on the ride path, and wherein the body comprises a transfer table with a first track for capturing the at least one of the passenger vehicles and a second track for guiding the other one of the passenger vehicles along the ride path when the transfer table is moved from an extended position into an inserted position.

11. The ride of claim 10, wherein the at least one of the passenger vehicles is maintained at a second speed differing from the first speed while in the simulation space of the simulator assembly.

12. The ride of claim 10, wherein the track comprises a closed-loop track.

13. A simulator-based amusement park ride, comprising:

a track;

passenger vehicles moving on the track at a first speed;

a simulation assembly configured to present a simulation to at least one of the passenger vehicles while positioned within a simulation space located apart from a ride path defined by the track; and a mechanism for transferring at least one of the passenger vehicles from the track to the simulation space, wherein the transferring mechanism comprises a body for first receiving the at least one of the passenger vehicles and second moving the at least one of the passenger vehicles out of the ride path defined by the track into the simulation space, whereby another one of the passenger vehicles may pass by the simulation assembly on the ride path, and wherein the body comprises a turntable rotatable from a first position for receiving the at least one of the passenger vehicles to a second position in which the at least one of the passenger vehicles is positioned in the simulation space.

14. The ride of claim 13, wherein the at least one of the passenger vehicles is maintained at a second speed differing from the first speed while in the simulation space of the simulator assembly.

15. The ride of claim 13, wherein the track comprises a closed-loop track.

16. A simulator-based amusement park ride, comprising:

a track;

passenger vehicles moving on the track at a first speed;

a simulation assembly configured to present a simulation to at least one of the passenger vehicles while positioned within a simulation space located apart from a ride path defined by the track; and a mechanism for transferring at least one of the passenger vehicles from the track to the simulation space, wherein the transferring mechanism comprises a body for first receiving the at least one of the passenger vehicles and second moving the at least one of the passenger vehicles out of the ride path defined by the track into the simulation space, whereby another one of the passenger vehicles may pass by the simulation assembly on the ride path, and wherein the body comprises an elevator with a first surface for receiving the at least one passenger vehicles, a lift device for moving the first surface vertically to place the first surface within the simulation space, and a second surface with a track portion for guiding the another one of the passenger vehicles along the ride path.

17. The ride of claim 16, wherein the at least one of the passenger vehicles is maintained at a second speed differing from the first speed while in the simulation space of the simulator assembly.

18. The ride of claim 16, wherein the track comprises a closed-loop track.

19. A ride system, comprising:

a closed-loop track;

first and second passenger vehicles each with a multi-degree of freedom base, the first and second passenger vehicles adapted for moving along a ride path defined by the track at a first speed;

a simulator assembly with an immersion environment located outside the ride path; and a vehicle transfer mechanism capturing the first passenger vehicle, transferring the first passenger vehicle from the track into the immersion environment, and, with the first passenger vehicle in the immersion environment, guiding the second passenger vehicle along the ride path past the simulator assembly, wherein the vehicle transfer mechanism rotates the first passenger vehicle during the transferring step such that the first passenger vehicle is oriented differently in the immersion environment than on the track.

20. The system of claim 19, wherein the first passenger vehicle moves at a second speed in the simulator assembly that is less than the first speed.

21. The system of claim 19, wherein the simulator assembly comprises a base actuator actuating the vehicle base while in the immersion space.

22. The system of claim 19, further comprising a load/unload station along the ride path a distance from the simulator assembly, whereby the second passenger vehicle is loaded or unloaded with passengers while the first passenger vehicle is positioned within the simulation space.

23. A ride system, comprising:

a closed-loop track;

first and second passenger vehicles each with a multi-degree of freedom base, the first and second passenger vehicles adapted for moving along a ride path defined by the track at a first speed;

a simulator assembly with an immersion environment located outside the ride path; and a vehicle transfer mechanism capturing the first passenger vehicle, transferring the first passenger vehicle from the track into the immersion environment, and, with the first passenger vehicle in the immersion environment, guiding the second passenger vehicle along the ride path past the simulator assembly, wherein the vehicle transfer mechanism comprises a table with a first track and a second track each alignable with the ride path and wherein the vehicle transfer mechanism is operable to first capture the first passenger vehicle in the first track and to second move the table to position the first track in the simulation space and concurrently move the second track into an aligned positioned with the ride path, whereby the second passenger vehicle is guided along the ride path.

24. The system of claim 23, wherein the first passenger vehicle moves at a second speed in the simulator assembly that is less than the first speed.

25. The system of claim 23, wherein the vehicle transfer mechanism rotates the first passenger vehicle during the transferring step such that the first passenger vehicle is oriented differently in the immersion environment than on the track.

26. The system of claim 23, wherein the simulator assembly comprises a base actuator actuating the vehicle base while in the immersion space.

27. The system of claim 23, further comprising a load/unload station along the ride path a distance from the simulator assembly, whereby the second passenger vehicle is loaded or unloaded with passengers while the first passenger vehicle is positioned within the simulation space.

28. A ride system, comprising:

a closed-loop track;

first and second passenger vehicles each with a multi-degree of freedom base, the first and second passenger vehicles adapted for moving along a ride path defined by the track at a first speed;

a simulator assembly with an immersion environment located outside the ride path; and a vehicle transfer mechanism capturing the first passenger vehicle, transferring the first passenger vehicle from the track into the immersion environment, and, with the first passenger vehicle in the immersion environment, guiding the second passenger vehicle along the ride path past the simulator assembly, wherein the transfer mechanism comprises a lift device or a robotic arm each operating to lift the first passenger vehicle vertically upward off of the track when the first passenger vehicle is transferred into the simulation space.

29. The system of claim 28, wherein the first passenger vehicle moves at a second speed in the simulator assembly that is less than the first speed.

30. The system of claim 28, wherein the vehicle transfer mechanism rotates the first passenger vehicle during the transferring step such that the first passenger vehicle is oriented differently in the immersion environment than on the track.

31. The system of claim 28, wherein the simulator assembly comprises a base actuator actuating the vehicle base while in the immersion space.

32. The system of claim 28, further comprising a load/unload station along the ride path a distance from the simulator assembly, whereby the second passenger vehicle is loaded or unloaded with passengers while the first passenger vehicle is positioned within the simulation space.

* * * * *